US005211085A

United States Patent [19]

Liou

[11] Patent Number: 5,211,085

[45] Date of Patent: May 18, 1993

[54] HAMMER

[76] Inventor: Mou T. Liou, No. 25, Lane 86, Tawei Rd, Tali Tsun, Tali Hsiang, Taichung Hsien, Taiwan

[21] Appl. No.: 861,012

[22] Filed: Mar. 31, 1992

[51] Int. Cl.[5] ..... B25D 1/00

[52] U.S. Cl. ..... 81/20; 81/489

[58] Field of Search ..... 81/20, 19, 25–27, 81/489, 490, 491, 492; 76/103; 7/143–147, 159, 167; 30/308.1, 308.2, 308.3, 318, 334, 329, 340, 342, 344

[56] References Cited

U.S. PATENT DOCUMENTS 604,624 5/1898 Marble ..... 30/308.2

4,519,108 5/1985 Hodgser ..... 7/167

4,558,726 12/1985 Clay ..... 81/20 X 4,773,286 9/1988 Krauth ..... 81/20

*Primary Examiner*—D. S. Meislin

*Attorney, Agent, or Firm*—Bacon & Thomas

[57] ABSTRACT

A hammer including a head, an opening formed in the head, a handle having a bifurcated portion formed on one end for engagement on the side portions of the head, the bifurcated portion of the handle includes two panels each having an orifice aligned with the opening of the head, a rivet engaged through the opening of the head and the orifices of the panels of the bifurcated portion so that the head and the handle are solidly coupled together.

2 Claims, 2 Drawing Sheets

HAMMER

BACKGROUND OF THE INVENTION

1. Field of the Invention

The present invention relates to a hammer and more particularly to a hammer having a solid coupling between the handle portion and the head portion.

2. Description of the Prior Art

A typical hammer includes a handle portion having one end inserted into a hole of a hammer head and fixed in place by several nails or screws. Two of the hammers are disclosed in U.S. Pat. Nos. 6,623 to Parker, and 1,711,505 to Mccracken. The hammer head is apt to be separated from the handle portion.

The present invention has arisen to mitigate and/or obviate the afore-described disadvantages of the conventional hammers.

SUMMARY OF THE INVENTION

The primary objective of the present invention is to provide a hammer in which the handle portion and the head portion are solidly coupled together.

In accordance with one aspect of the invention, there is provided a hammer comprising a head including two side portions, an opening laterally formed in the head and formed between the side portions of the head, a handle including a first end having a bifurcated portion formed thereon for engagement on the side portions of the head and a second end having a grip disposed thereon, the bifurcated portion of the handle including two panels each having an orifice formed thereon and aligned with the opening of the head, a first engaging means engaged through the opening of the head and the orifices of the panels of the bifurcated portion of the handle, whereby, the head and the handle are solidly coupled together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
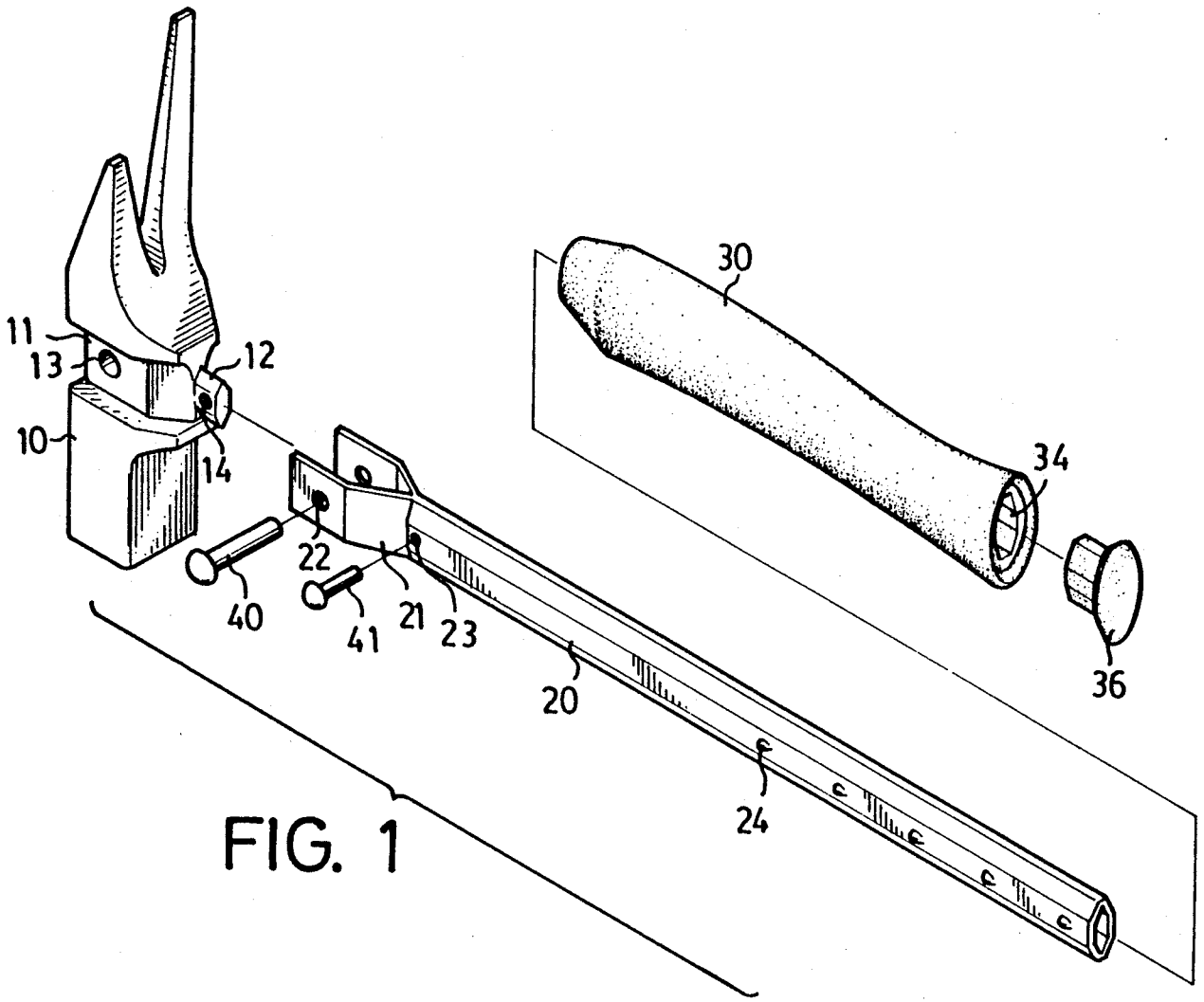
FIG. 1 is an exploded view of a hammer in accordance With the present invention.
Figure 3:
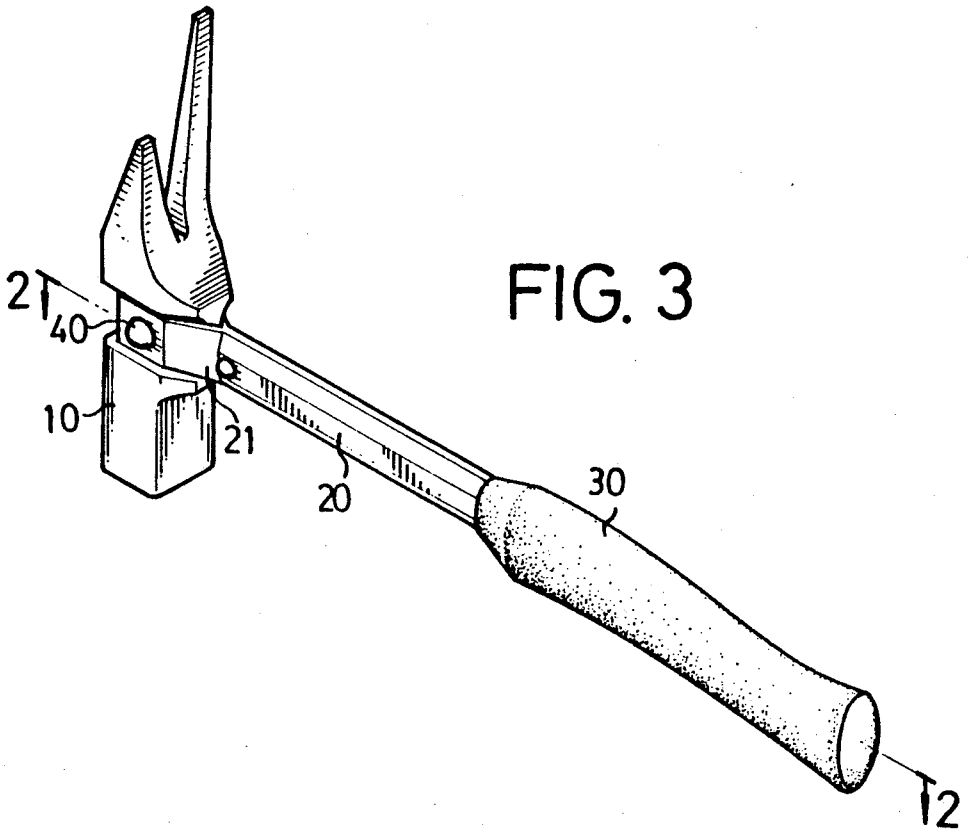
FIG. 3 is a perspective view of the hammer.
Figure 2:
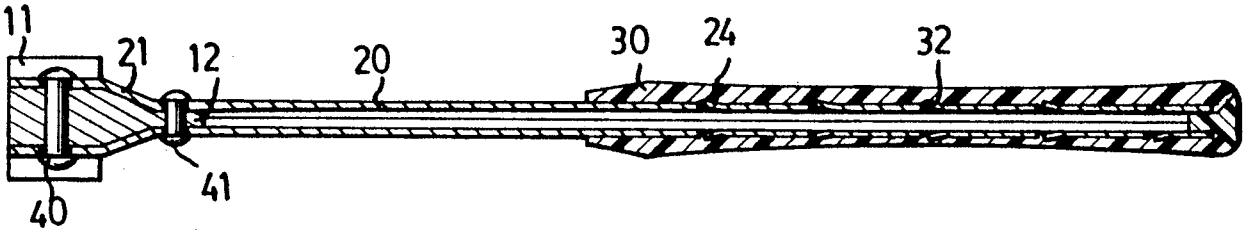
FIG. 2 is a cross sectional view of the hammer, taken along lines 2—2 of FIG. 3.

Referring to the drawings, a hammer in accordance with the present invention comprises generally a handle 20 having a head 10 fixed on one end and having a grip 30 engaged o the other end thereof.

The head 10 includes two sides each having a slot 11 formed therein and substantially perpendicular to the longitudinal direction of the head 10. An opening 13 is formed in the head 10 and formed between the slots 11. An extension 12 is formed integral With the head 10 and located in the abutment portion of the slots 11, and has an aperture 14 formed therein.

The handle 20 is substantially Y-shaped including a bifurcated portion 21 formed in a first end thereof for engagement in the slots 11 of the head 10. The handle 20 has a hollow interior for receiving the extension 12 of the head 10 when the head 10 is engaged in the bifurcated portion 21 of the handle 20. The bifurcated portion 21 includes two panels each having an orifice 22 formed therein and aligned with the opening 13 of the head 10 when the head 10 is engaged to the handle 20, and a rivet 40 and the like is engaged through the orifices 22 and the opening 13 of the head 10 so that the head 10 and the handle 20 are solidly fixed together. A hole 23 is formed in the abutment portion of the bifurcated portion 21 and the handle 20 and aligned with the aperture 14 of the extension 12, and a rivet 41 is engaged through the hole 23 and the aperture 14 of the extension 12 so that the head 10 and the handle 20 can further be solidly fixed together.

It is preferable that the extension 12 of the head 10 has a cross section corresponding to the cross section of the interior of the handle 20, and the extension 12 is arranged such that it can be snugly engaged in the hollow interior of the handle 20. The handle 20 includes a plurality of protrusions 24 formed on the second end portion thereof. The grip 30 is engaged on the second end portion of the handle 20. It is preferable that a plurality of recesses 32 are formed in the grip 30 for engagement with the protrusions 24 of the handle 20 such that the grip 30 can be solidly engaged on the second end portion of the handle 20. Each of the protrusions 24 has an inclined outer portion arranged for facilitating the insertion of the grip 30, and the engagement of the protrusions 24 in the recesses 32 of the grip 30 prevents the grip 30 from being separated from the handle 20. The grip 30 includes a cap 36 engageable in the open rear end 34 thereof such that nails or screws can be disposed in the hollow interior of the handle 20 before the cap 36 is engaged in place in the rear end of the grip 30.

Accordingly, the hammer in accordance with the present invention includes a head and a handle which are solidly coupled together and can be prevented from separating from each other.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A hammer comprising a head including two side portions each having a slot formed therein, the slot extending across the entire width of the head, the head defining an opening extending laterally through said head between said slots in said side portions of said head; an extension integrally formed on said head so as to extend therefrom and defining an aperture therein; a handle having a first bifurcated end portion formed therein and a second end portion having a grip disposed thereon, said bifurcated portion of said handle defining two panels engaged in said slots of said head and each having an orifice formed thereon and aligned with said opening of said head, said handle including a hollow interior for receiving said extension of said head when said head is engaged in said bifurcated portion of said handle, said hollow interior of said handle having a cross section corresponding to a cross section of said extension such that said extension is snugly engaged in said hollow interior of said handle; a hold defined by said first end portion of said handle aligned with said aperture in said extension; a first engaging means engaged through said opening of said head and said orifices of said panels of said bifurcated portion of said handle; and a second engaging means engaged through said hole of said handle and said aperture of said head; whereby, said head and said handle are solidly coupled together.

2. A hammer according to claim 1, further comprising at least one protrusion formed on said second end of said handle and, at least one recess formed on said grip for engagement with said protrusion of said handle such that said grip is solidly coupled to said handle.

* * * * *